US009711026B2

(12) United States Patent
Forbes

(10) Patent No.: US 9,711,026 B2
(45) Date of Patent: Jul. 18, 2017

(54) FOOTWEAR ARRANGEMENT WITH BATTERY AND ANTI-THEFT PROTECTION

(71) Applicant: Brandon F. Forbes, Lansing, MI (US)

(72) Inventor: Brandon F. Forbes, Lansing, MI (US)

( * ) Notice: Subject to any disclaimer, the term of this patent is extended or adjusted under 35 U.S.C. 154(b) by 41 days.

(21) Appl. No.: 14/630,967

(22) Filed: Feb. 25, 2015

(65) Prior Publication Data

US 2016/0247379 A1 Aug. 25, 2016

(51) Int. Cl.

| | |
|---|---|
| ***G08B 1/08*** | (2006.01) |
| ***G08B 21/02*** | (2006.01) |
| ***A43B 3/00*** | (2006.01) |
| *G08B 13/14* | (2006.01) |
| *G08B 15/00* | (2006.01) |
| *G08B 21/24* | (2006.01) |

(52) U.S. Cl.

CPC ..... *G08B 21/0288* (2013.01); *A43B 3/001* (2013.01); *A43B 3/0021* (2013.01); *G08B 21/023* (2013.01); *G08B 21/0205* (2013.01); *G08B 21/0227* (2013.01); *G08B 21/0269* (2013.01); *G08B 21/0277* (2013.01); *G08B 21/0291* (2013.01); *G08B 13/1436* (2013.01); *G08B 15/00* (2013.01); *G08B 21/0222* (2013.01); *G08B 21/0283* (2013.01); *G08B 21/24* (2013.01)

(58) Field of Classification Search

CPC .. A43B 3/0005; A43B 17/00; H04M 2250/12; H04M 1/72572; H04M 2250/10; H04M 3/5116; H04M 1/72569; Y02B 60/1242; H04W 4/02; H04W 52/027; G01S 19/49; G01S 19/19; G01C 21/16; G01C 22/00; G01C 25/005; G06F 2221/2111; G08B 21/0446; G08B 21/0453; G08B 21/0211; G08B 25/10; G01P 15/00; G01P 1/127; G01P 3/50

USPC ..... 340/539.13, 539.11, 539.1

See application file for complete search history.

(56) References Cited

U.S. PATENT DOCUMENTS

| | | | | |
|---|---|---|---|---|
| 6,278,370 | B1 | 8/2001 | Underwood | |
| 6,396,403 | B1 | 5/2002 | Haner | |
| 6,788,200 | B1 | 9/2004 | Jamel et al. | |
| 7,265,666 | B2 | 9/2007 | Daniel | |
| 7,474,206 | B2 | 1/2009 | Bertagna et al. | |
| 7,920,059 | B2 | 4/2011 | Bertagna et al. | |
| 8,077,030 | B2 | 12/2011 | Kaminski et al. | |
| 8,739,639 | B2 * | 6/2014 | Owings | A43B 3/0005 73/862.046 |
| 2007/0129907 | A1 * | 6/2007 | Demon | A43B 3/0005 702/127 |
| 2008/0204223 | A1 * | 8/2008 | Chu | G01C 22/006 340/539.13 |
| 2009/0278707 | A1 * | 11/2009 | Biggins | A43B 1/0027 340/870.16 |

(Continued)

FOREIGN PATENT DOCUMENTS

| | | | | |
|---|---|---|---|---|
| GB | 2352551 A | * | 1/2001 | A43B 3/00 |

*Primary Examiner* — Emily C Terrell

(74) *Attorney, Agent, or Firm* — Warn Partners, P.C.

(57) ABSTRACT

A footwear arrangement including a wireless interface device capable of sending input signals and receiving output signals to a first shoe having a primary controller. The primary controller sends signals to the second shoe, which has a slave controller that is controller that is controlled by signals from the primary controller.

30 Claims, 7 Drawing Sheets

(56) References Cited

U.S. PATENT DOCUMENTS

| | | | | |
|---|---|---|---|---|
| 2010/0289971 | A1* | 11/2010 | Odland | A43B 1/0027<br>348/801 |
| 2011/0170311 | A1* | 7/2011 | Reuben | A43B 1/0036<br>362/554 |
| 2011/0260857 | A1* | 10/2011 | Hamill | A43B 3/0005<br>340/539.13 |
| 2012/0266493 | A1 | 10/2012 | Moss | |

* cited by examiner

FOOTWEAR ARRANGEMENT WITH BATTERY AND ANTI-THEFT PROTECTION

FIELD OF THE INVENTION

The present invention relates to a footwear arrangement and other clothing, apparel and accessories having anti-theft, alarm shoe locator and Amber Alert safety arrangement.

BACKGROUND OF THE INVENTION

In the footwear industry there is a need to provide consumers with new accessories that allow a person to tailor their footwear to their own individual tastes of style. Additionally, there is also a need to make footwear more utilitarian and provide a user with added benefits or features. For example, shoes having flashing lights not only provide the user with stylistic benefits; the lights also provide a useful safety benefit when worn at night. Additionally the increased cost of shoes incorporating electronics also presents the need to prevent theft or misplacement of the shoes. In addition there is a need to provide emergency devices on clothing, including shoes that allows for tracking and protecting the person wearing the clothing or footwear.

SUMMARY OF THE INVENTION

A footwear arrangement including a wireless interface device capable of sending input signals and receiving output signals. A first shoe and a second shoe each have a display panel flexibly connected thereon.

A primary controller is connected to the first shoe and controls two or more modes of operation for displaying personalized content on the display panel of the first shoe. The personalized content and the modes of operation can be changed or erased by the primary controller. A slave controller is connected the second shoe and controls the two or more modes of operation for displaying personalized content on the display panel of the second shoe. The personalized content and the modes of operation can be changed or erased on the slave controller.

The first shoe also includes a first shoe wireless communication bus with a first wireless controller contained within the first shoe. There is also a second shoe wireless communication bus with a second wireless controller contained in the second shoe. The first shoe wireless communication bus is capable of wireless communication between the first shoe wireless communication bus and the second shoe wireless communication bus or sending and receiving output signals or input signals between the first shoe wireless communication bus and the wireless interface device. The first wireless controller communicates with the primary controller and the second wireless controller and the second wireless controller communicates with the first wireless controller, using the first and second shoe wireless communications buses and the slave controller by a direct connection between the second wireless controller and the slave controller. The types of signals transmitted include signals related to input signals and output signals from the wireless interface device.

An accelerometer in the first shoe is capable of detecting movement within at least two axes. The accelerometer is connected to and capable of generating one or more motion signals to the primary controller and the primary controller will generate a hibernation mode signal so the slave controller and the primary controller will both operate in a hibernation mode when one or more motion signals are not received by the primary controller for a preset time period programmed on the primary controller.

A first shoe rechargeable battery located in the first shoe for provides power to said primary controller, display panel in the first shoe, first shoe wireless communication bus and the accelerometer in the first shoe. A second shoe rechargeable battery located in the second shoe provides power to the slave controller, the display panel in the second shoe, the second shoe wireless communication bus and the accelerometer in the second shoe.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
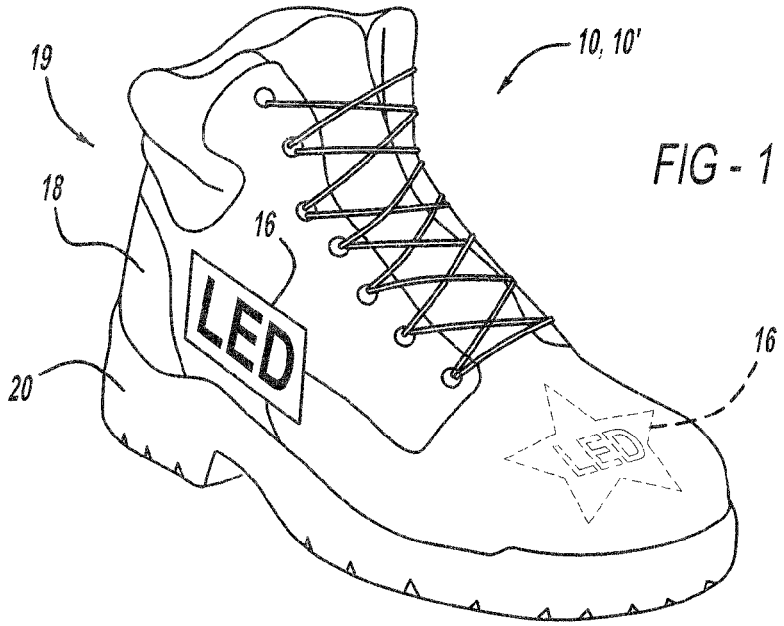
FIG. 1 is a perspective angled view of the invention integrated into a boot.
Figure 2:
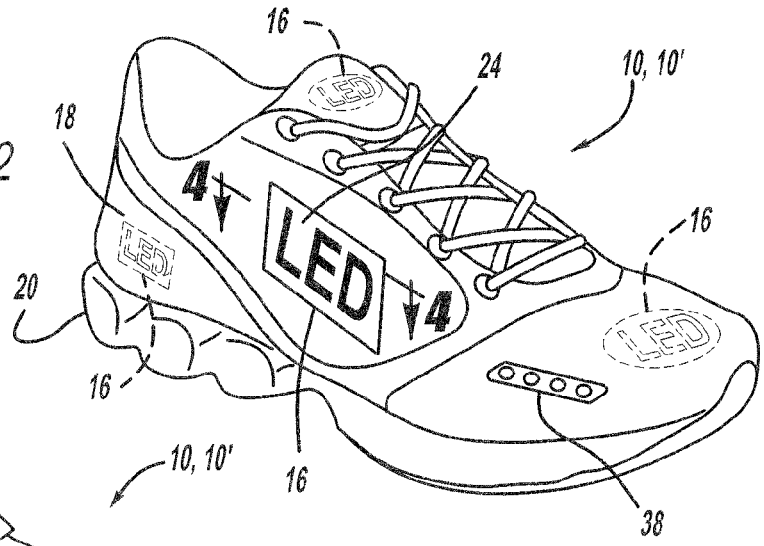
FIG. 2 is a perspective angled view of the invention integrated into a athletic shoe.
Figure 3:
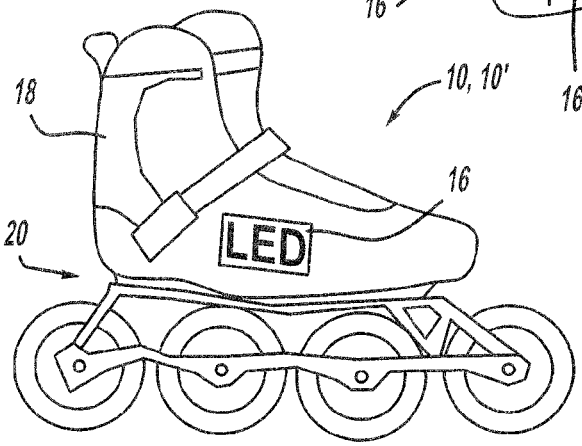
FIG. 3 is a side plan view of the invention used in a skate shoe embodiment.
Figure 4:
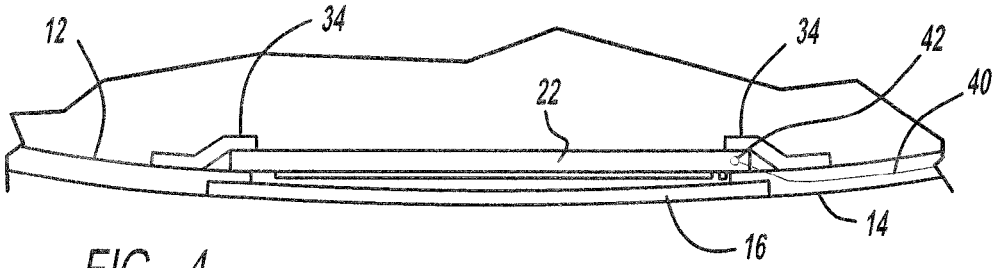
FIG. 4 is a partially sectioned plan overhead view of one embodiment of the invention incorporated on a shoe.
Figure 6:
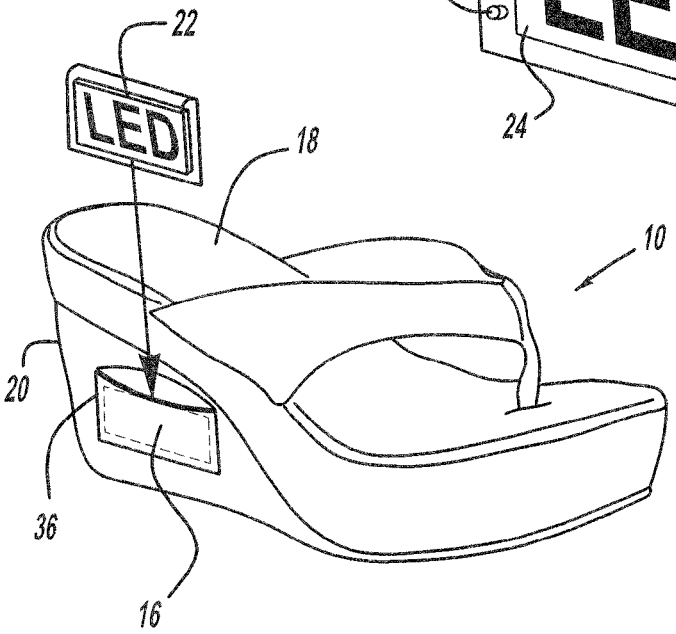
FIG. 6 is a perspective side angled view of the another embodiment of the invention incorporated on a sandal using an alternate attachment.

Referring now to FIGS. 1-3 and 6, an embodiment of the present invention is shown being incorporated on a footwear arrangement 10, 10' which is shown to be a single shoe, however, the present invention includes a pair of shoes which will be designated 10, 10' for indicating a left side shoe or a right side shoe. The footwear arrangement 10, 10' has an inner surface 12, an outer surface 14, and a window 16. Each of the Figures displays a slight variation in that the invention is being used with various types of footwear. For example, FIG. 1 depicts the invention incorporated on a boot; FIG. 2 shows the invention on an athletic shoe, FIG. 3 shoes the invention on a skate shoe which can include roller skates, inline skates, roller shoes, snowboard brackets, snow skis and ice skates. FIG. 6 shows the invention on a sandal or dress shoe. Additionally other types of footwear can be used including slippers, golf shoes, etc. Each of the Figures are not intended to be limiting with respect to the particular type of footwear used for the present invention, but rather serve the purpose of illustrating the number of different configurations that can be used with virtually any type of footwear. The window 16 can be located anywhere on the outer surface 14 of the footwear arrangement 10, 10'. FIGS. 1 and 2 show in phantom lines various alternate locations of the window 16 for placement of the programmable display 22. For example the window 16 can be on the toe, buckles, straps, tongue, heel, and sides of the footwear arrangement 10, 10'. Additionally the shape of the programmable display 22 and the window 16 is not limited to a rectangular shape but can include any kind of shape. FIGS. 1 and 2 show a circular and star shaped window 16 and programmable display.

The footwear arrangement 10, 10' has an upper 18 including a heel 19 and a lower 20, which includes the sole. However, the term lower is referring to the surface or a sole of the footwear arrangement 10, 10' that is used for at least in part communicating with the surface under the footwear arrangement 10, 10'. For example, in FIG. 3 the skate shoe embodiment of the footwear arrangement 10, 10' has a lower 20 that would include the roller unit which is the part that communicates with the ground during use.

Referring now to FIGS. 1-6, all of the footwear arrangements 10, 10' have a programmable display 22 incorporated with the footwear arrangements 10, 10'. The programmable display 22 has a display panel 24 with one or more buttons 26 that are operably configured with a controller 28 that is part of the circuitry of the programmable display 22. It is within the scope of this invention for the programmable display 22 to not have one or more buttons 26 and be programmed wirelessly using a wireless device, which is shown and described hereafter. It is also within the scope of this invention for the controller 28 to be located separate from the programmable display, but connected to the programmable display that just includes a display panel 24 in a manner that will allow the controller to send signals and control the mode and content of the programmable display 22. The controller 28 controls the projection of light from the display panel 24 and further controls the pattern of light that is emitted from the panel 24. The controller 28 stores data such as text, numbers, logos, symbols, or other relevant information that can be projected from the display panel 24.

The controller 28 also has one or more modes of operation that are activated by the one or more buttons 26 to cause information to be displayed on the panel 24 in a desired mode. For example, the controller 28 can have two or more modes of operation that include on, off, scrolling, flashing, exploding, hold, timed, random display, and combinations thereof. The scrolling mode of operation would cause the information to scroll across the panel 24 at a predetermined rate of speed or rates of speed. The information can move across the panel 24 horizontally, vertically, diagonally or in any other direction. The flashing mode would cause the information to be flashed on the panel 24. The exploding mode would involve displaying the information and then having it break apart like it was exploding. The hold mode of operation would cause the information to be presented on the panel 24 and held there for a user determined amount of time. The timed mode of operation would cause various groupings of information to be placed on the panel 24 for a predetermined amount of time. The random display mode would cause the controller 28 to randomly display information on the display 24 in any of the aforementioned modes. The various modes of operation can be selected using the one or more buttons 26 on the programmable display 22.

The kind of information that can be stored and displayed includes, but is not limited to information for conveying personal content such as pictures, photos, designs, drawings, different languages, patterns, text, graphics, slogans, colors, phrase, shapes, numbers, logos, brand markings including trademarks, messages and any combinations of the above.

The programmable display 22 can be preprogrammed with data that cannot be changed. The programmable display 22 can be blank and require the user to add their own personal content, or the programmable display 22 can be reprogrammable so it has information already stored but the information can be changed or erased at the user's discretion.

In order to change or upload information onto the controller 28 a data port 30, which can be a USB link or other suitable port located on the surface of the programmable display 22, can be used to input information to the controller 28. The port 30 can also be used to charge a power source 32 of the programmable display 22. The power source 32 of the programmable display 22 can be a rechargeable battery, such as a lithium ion battery or other suitable battery source. Other embodiments provide charging the battery using an electric outlet via a power port or USB connector, solar power, kinetic energy, or any other suitable source that is operably connected to the power source 32. Additionally as shown in FIG. 2 a power indicator 38 can be installed on any outside surface of the footwear arrangement 10, 10' and it is also possible for the indicator to be a part of the panel 24 or anywhere else of the programmable display 22. The power indicator 38 is a visual indicator of how much energy the power source 32 has available before needing to be recharged. The power indicator 38 can operate via a wireless signal from the programmable display 22 or a contact 42, shown in FIGS. 4-5, allows for a wire 40 to connect with the programmable display 22 when placed into the carrier 34. The wire 40 can be attached to the inside surface 12, the outside surface 14 or embedded between the inside surface 12 and outside surface 14 of the footwear arrangement 10, 10'.

In another embodiment of the invention, the controller 28 of the programmable display 22 can have a counter mode that allows the controller 28 to collect and store data such as time, distance, or speed. The controller 28 of the programmable display 22 includes other electronics such as a global positioning system or pedometer that would allow the programmable display 22 to keep track of distance or speed. The information gathered by the counter can then be projected from the display panel 24. This particular aspect of the invention would be helpful for keeping track of pace, distance, or speed during an event such as exercising or competitive running or walking instead of having to download or transmit the data to an external device such as an MP3 player.

Another alternate embodiment allows the counter to be used to keep track of time allowing the footwear arrangement 10, 10' to be used as a continuous scrolling clock which projects time on the panel 24. The controller 28 can also further include an alarm mechanism so that the footwear arrangement 10, 10' would function in the place of an ordinary alarm clock or a stop watch. Additionally the programmable display 22 can have an internal digital thermometer that can display ambient temperature.

The programmable display 22 can be permanently attached or removeably connected to the footwear arrangement 10, 10'. When the programmable display 22 is connected the panel 24 is operably aligned with the window 16 so that information emitted on the panel 24 can be seen through the window 16. The programmable display 22 is held in place by a carrier 34 which is a bracket type member operably connected to the inner surface 12 of the footwear arrangement 10, 10'. Alternatively, it is possible for the carrier 34 to be connected to the outer surface 14 of the footwear arrangement 10, 10'.

In another alternate embodiment shown in FIG. 6, there is a pocket 36 that is located on the outer surface 14 of the footwear arrangement 10, 10'. The programmable display unit 22 slides into the pocket 36 as opposed to using brackets for securing the programmable display unit 22 to the footwear arrangement 10, 10'.

Figure 7:
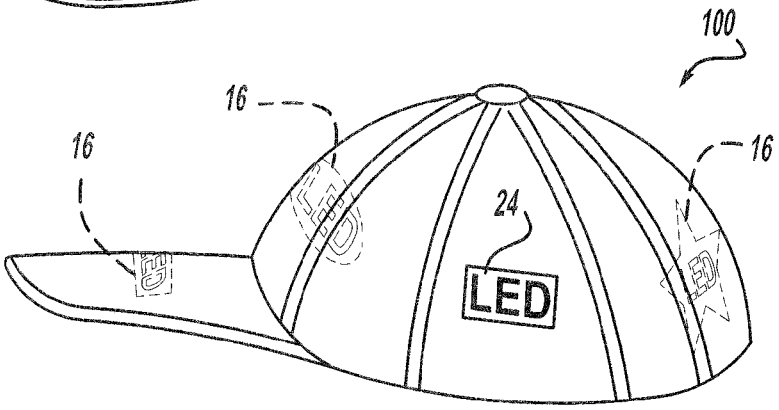
FIG. 7 is a side perspective view of an alternate embodiment of the invention incorporated on a hat.

While FIGS. 1-3 and 6 depict the programmable display unit 22 being used with a footwear arrangement 10, 10', it is possible to use the programmable display unit 22 with other types of objects or articles of clothing. For example, FIG. 7 depicts an alternate embodiment of the invention where the programmable display unit 22 is integrated with a hat 100. The invention still utilizes the use of a carrier or pocket with a window and a programmable display as described in the embodiment shown in FIGS. 1-3 and 6; however, the difference is that the object is now a hat 100. It is also possible to use the invention having a programmable display and a carrier, with other types of clothing such as shirts, neckties, glove, helmets, pants, jackets, headbands, wristbands, belts, or undergarments. It is also possible to use the programmable display unit 22 with other non-clothing objects such as mugs, plates, key chains, jewelry, tire rims, etc.

The types of information from the display panel 24 are projected using a light source such as one or more inorganic light emitting diodes (LED). The light emitting diode or LED technology allows for information to be scrolled across the display panel 24 during the various modes of operation. Furthermore, the use of the one or more light emitting diodes allows for the information on the display panel 24 to appear to be moving or graphically animated in modes of operation that involve the scrolling, flashing, or exploding of information across the display panel 24. In addition to an LED light source, the light source can also be any other suitable type of light source capable of allowing for the display of information on the programmable display unit 22 in a desired manner. For example, the LED display unit can also include liquid crystal display (LCD) technology as well as a plasma light source.

Figure 8:
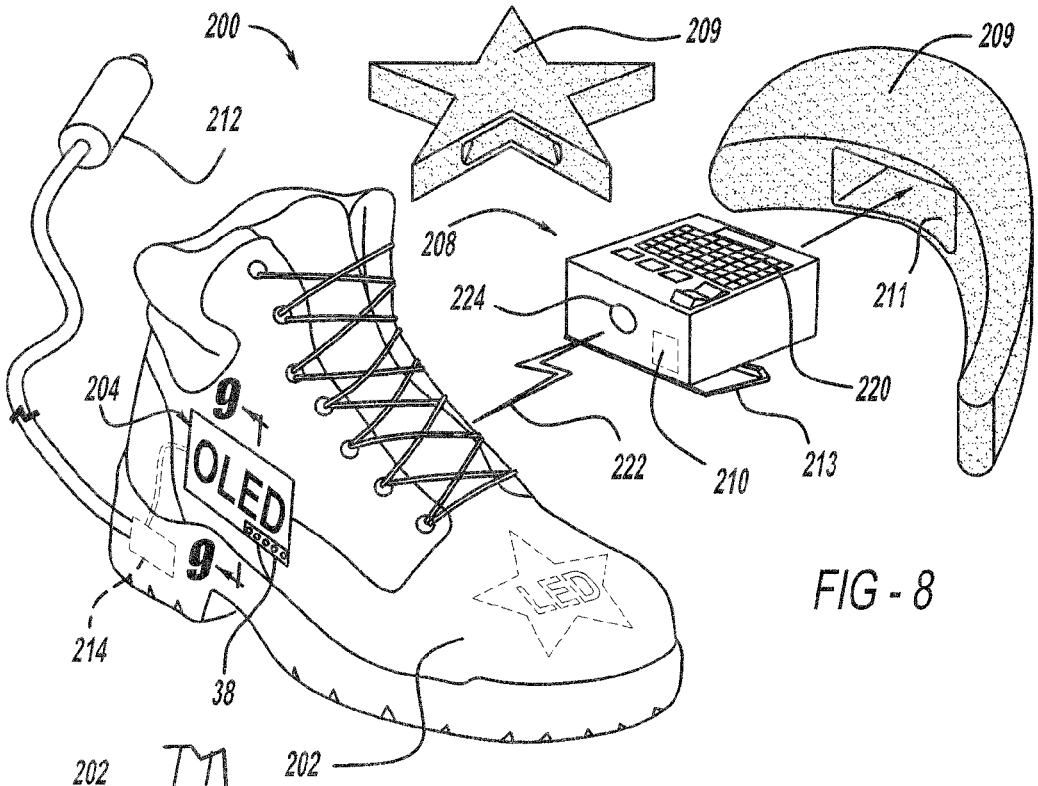
FIG. 8 is a perspective view of an alternate embodiment of the invention utilizing a controller for wirelessly programming the display panel.
Figure 9:
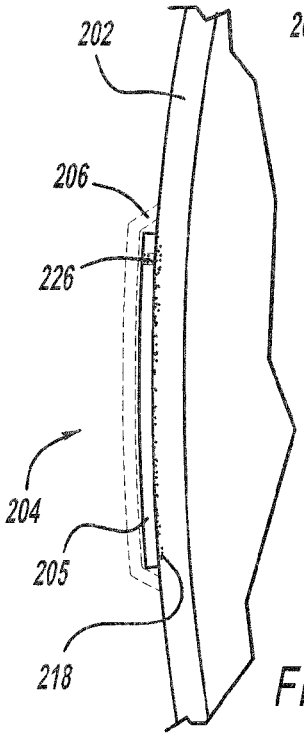
FIG. 9 is a cross-sectional view taken along the section lines 9-9 in FIG. 8.

FIGS. 8-9 show an alternate embodiment of a footwear arrangement 200 having a footwear arrangement 202 with a programmable display 204. Just like the previous embodiments, the programmable display 204 can be located anywhere on the exterior surface of the footwear arrangement 202. The programmable display 204 includes all of the features of the programmable display 22 described above and shown in the FIGS. 1-7. However, in this particular embodiment the programmable display 204 incorporates a flexible display that can be connected to the exterior of the footwear arrangement 202 without the need for a carrier or pocket. The programmable display 204 in the present embodiment utilizes technology known as organic light emitting diode (OLED) technology that provides a programmable display 204 that is much thinner than an inorganic LED. The OLED programmable display 204 has a flexible thin layered panel 205 that is connected to the exterior of the footwear arrangement 202 through the use of a fastening layer 218 which can be any suitable adhesive material. This allows the panel 205 to be adhered to and be flexible with the surface to which it is attached. In another aspect of the present embodiment of the invention, a window 206 is applied over the panel 205 of the OLED programmable display 204; however, this is an optional addition. The use of the OLED programmable display 204 or a programmable display having an LED can include the features of a display that is water resistant, heat resistant, and stress resistant. This makes the OLED programmable display 204 more practical for use on clothing which can be exposed to stress, water, and heat. Additionally, if the window 206 is applied over the panel 205 the water, heat, and stress resistant properties are further enhanced.

The OLED programmable display also includes a power source 214 that can be positioned apart from the panel 205 or it can be part of the panel 205. The power source 214 includes a battery storage or power generating device suitable for providing power for the operation of the OLED programmable display 204. The power source 214 can be connected to a plug-in energy source 212 to receive and store power. The plug-in energy source 212 can be any type of a plug-in connector such as an electrical cord, cigarette lighter, adaptor, or other suitable connector.

Another aspect of the present embodiment is a controller 208 provided external to the footwear arrangement 202. The controller 208 is in the form of a remote or wireless type of controller 208 that allows for communication between the controller 208 and the programmable display 204. The programmable display 22 shown in FIGS. 1-7 can also utilize a wireless controller in the same manner as shown in FIGS. 8-9. The controller 208 is configured to be connectable and interchangeable with one or more stylized housings 209 which can have various shapes or styles. The stylized housings 209 have an aperture 211 for receiving and holding the controller 208. Additionally, the controller 208 can also have a clip 213 allowing it to be connected to an object as desired by the user.

The controller 208 also has a counter 210 much like the counter in the first embodiment of the invention described above. The counter 210 is capable of collecting and storing data to be transmitted to the programmable display 204. The controller 208 has a control panel 220 where a user can program the controller to send signals regarding the various modes of operation and information to be displayed using the programmable display 204. The programmable display 204 includes a sensor 226 which receives wireless signals 222 that are transmitted from the controller 208. The programmable display 22 using an LED can also include the sensor 226 for communicating with a controller. The controller 208 can use several types of wireless signals which include blue-tooth type technology, infrared, sonic, or other light waves for communicating signals to the programmable display. The controller 208 can include a transmitter eye 224 for facilitating the transmission of the wireless signals 222; however, this may or may not be a necessary feature depending on the type of wireless signals 222 being transmitted.

An additional feature of the footwear arrangement 200 includes a lock feature incorporated into the components to lock the information being displayed on the programmable displays 22, 204. The lock can be a switch located as one of the buttons on the controller 208 or it can be a switch located on the programmable display 22, 204.

The wireless signals 222 can be continuously transmitted between the controller 208 and the programmable display 204 where the controller 208 is tasked with storing and carrying out all the logic functions of the footwear arrangement 200. Alternatively, the programmable display 204 can have logic circuitry built therein which can retrieve data via the wireless signals 222 from the controller 208 and control the information that is displayed on the programmable display 204.

Figure 10:
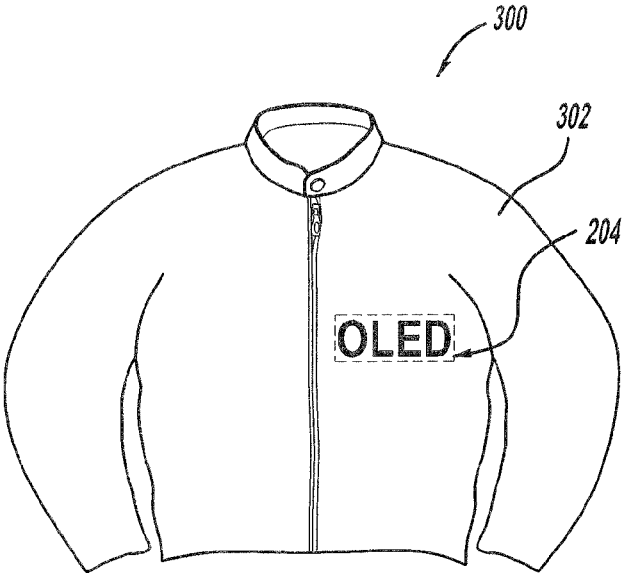
FIG. 10 is an alternate embodiment of the invention where the display panel is incorporated on a different article of clothing such as a jacket.

In another embodiment of the invention shown in FIG. 10, the OLED programmable display 204 is connected to a jacket unit 302 as part of a jacket arrangement 300. The use of the OLED programmable display 204 makes the present embodiment of the invention more versatile for use on other articles of clothing including shirts, hats, pants, etc. because of the thin flexible nature of the OLED and the elimination of the need to have a carrier member built into the article of clothing. With the present invention, the OLED programmable display 204 can be adhered to and flex with the article of clothing that it is connected to. The present invention is intended to be utilized with any type of clothing article.

Figure 11:
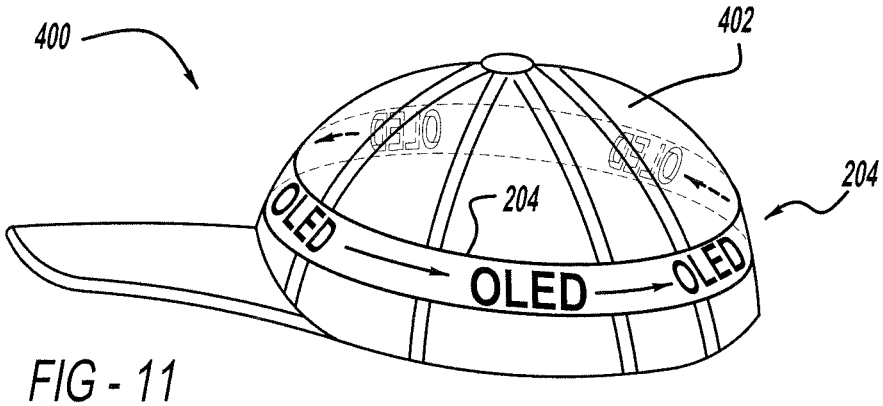
FIG. 11 is an alternate embodiment of the invention where an OLED display panel is incorporated on a hat.

In another embodiment of the present invention shown in FIG. 11, the OLED display 204 is connected to an OLED hat arrangement 400. The use of the OLED programmable display 204 makes the present embodiment of the invention more versatile because the OLED programmable display 204 is bent in a circular fashion and connected to the hat 402 allowing for information on the OLED display panel 204 to be continuously scrolled around the hat 402.

Figure 12:
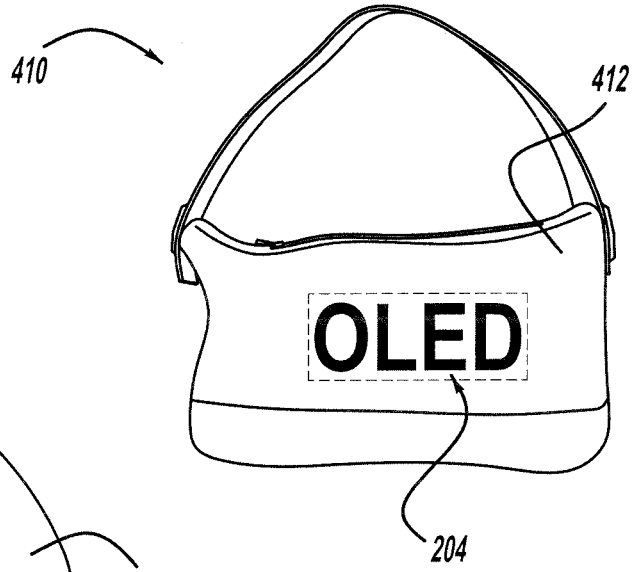
FIG. 12 is an alternate embodiment of the invention where the display panel is incorporated on a purse.
Figure 13:
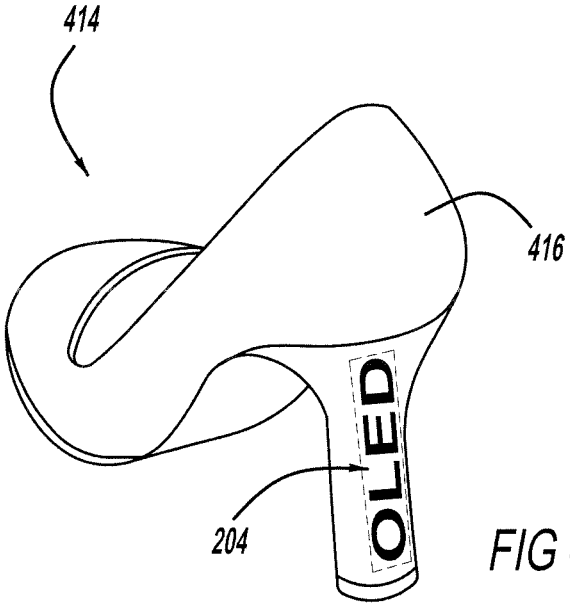
FIG. 13 is an alternate embodiment of the invention where an OLED display panel is incorporated on a high heeled shoe.

FIG. 12 shows another embodiment of the present invention where the OLED programmable display 204 is connected to a purse unit 412 as part of a purse arrangement 410. Once again, the OLED programmable display 204 can flex with the outer exterior of the purse unit 412. FIG. 13 depicts yet another embodiment of the invention where the OLED programmable display 204 is connected to a high heeled shoe 412 as part of a high heeled shoe arrangement 414. The OLED unit 204 can flex to accommodate the contours of the outer surface of the high heeled shoe 412.

Referring now to FIGS. 14-19 a footwear arrangement 500 in accordance with the present invention is shows and described herein. The foot wear arrangement 500 may be used in connection with any of the above described footwear arrangements 10, 10' shown and described in FIGS. 1-6, 8, 9 and 13 wherein the displays are operated using the footwear arrangement 500 described in accordance with the present embodiment of the invention. The footwear arrangement includes a first shoe 502 and a second shoe 504, which may be a left side or right side shoe respectively or vice-versa.

Figure 5:
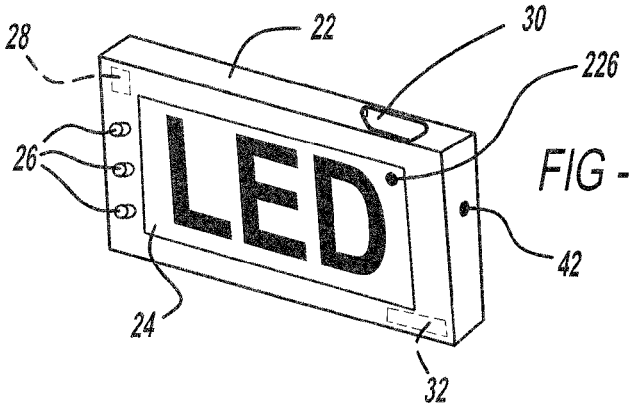
FIG. 5 is a perspective front view of the programmable display device in accordance with one embodiment of the invention.

The footwear arrangement 500 includes a wireless interface device 506 capable of sending input signals 503 and receiving output signals 503' with the first shoe 502 or sending input signals 501 and receiving output signal 501' with the second shoe 504. The wireless interface device 506 is a smart phone or tablet with a software app that will take user inputted information and generate input signals 501, 503 and receive output signals 501',503' to the user of the wireless interface device 506. Alternatively the wireless interface device 506 is the remote 208 as shown in FIG. 8 or the reprogrammable display 22 with buttons 26 as shown in FIG. 5. The wireless interface device 506 in the present invention communicates using radio frequency waves, including but not limited to Bluetooth® wireless communication.

The first shoe 502 and the second shoe 504 both have a display panel 508, 508' flexibly connected on their outer surface, which functions in a manner similar to the display panels described in all of the embodiments above. The display panel 508, 508' in accordance with one aspect of the present invention is a thin film display that consists of one of the following: Organic light emitting diode/device/display (OLED), active matrix organic light emitting diode (AMOLED), flexible organic light emitting diode (FOLED), phosphorescent organic light emitting diode (PhOLED), polymer light emitting diode (PLED), passive matrix organic light emitting diode (PMOLED), polymer organic light emitting diode (POLED), resonant color organic light emitting diode (RCOLED), small molecule organic light emitting diode (SmOLED), stacked organic light emitting diode (SOLED), transparent organic light emitting diode (TOLED), and neon organic iodine diode (NOID), etc.

As indicated in the embodiments above the display panel 508, 508' can be used to display messages, images or simply light up according to different patterns.

Figure 14:
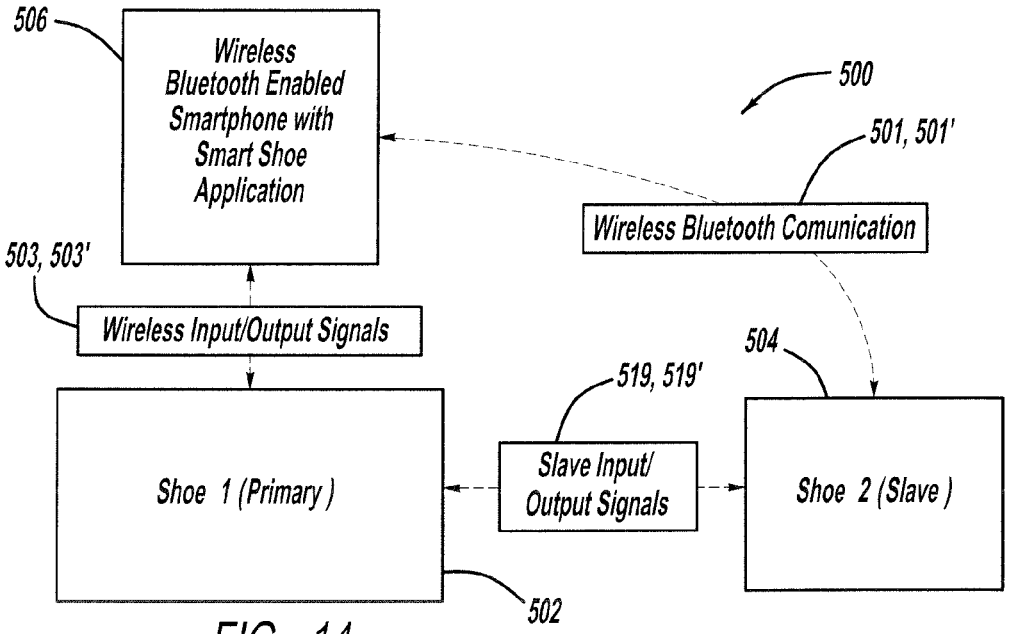
FIG. 14 is a schematic diagram of a footwear arrangement in accordance with one embodiment of the present invention.
Figure 15:
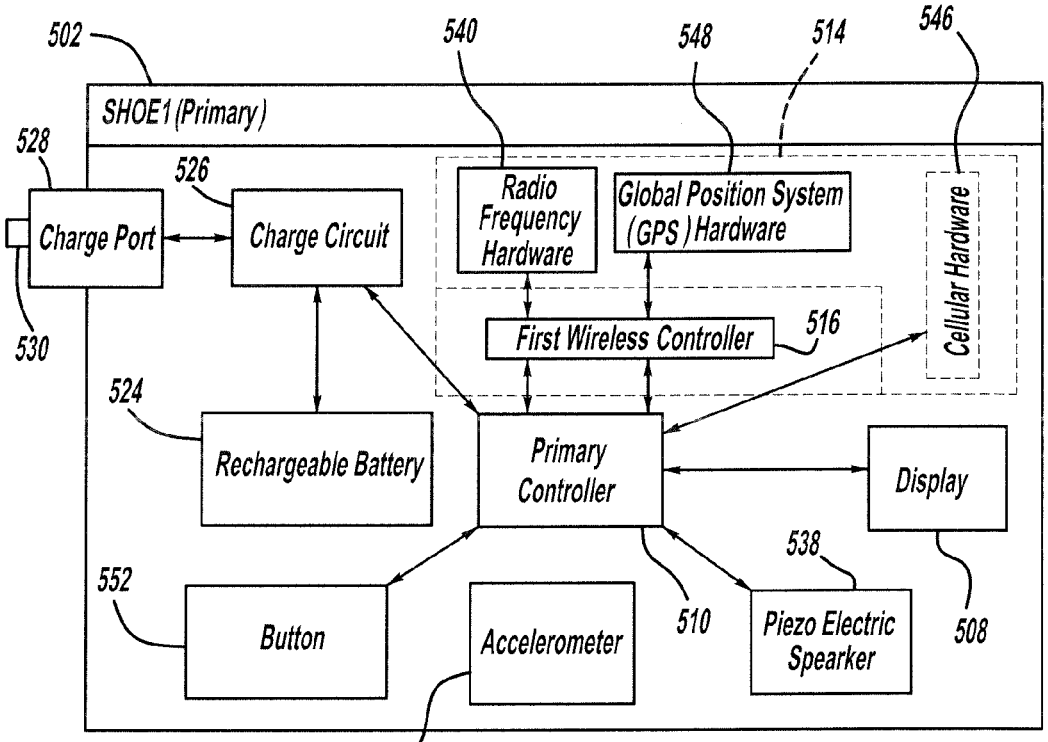
FIG. 15 is a schematic diagram of a first shoe.

Referring now to FIG. 14 and FIG. 15 details of the components of the first shoe 502 are shown. There is a primary controller 510 connected to said first shoe 502 that controls two or more modes of operation for displaying personalized content on the display panel 508 of the first shoe 502. The personalized content and modes of operation can be changed or erased by the primary controller 510 as programmed by input signals 503 transmitted by the wireless interface device 506. The input signals 503 generated from said wireless interface device 506 include operational signals that direct the primary controller 510, and slave controller 512 via signals from the primary controller 510 discussed below, to operate the display panel 508,508' on the first shoe 502 and second shoe 504 in one of two or more modes of operation and change or erase said personalized content.

Figure 16:
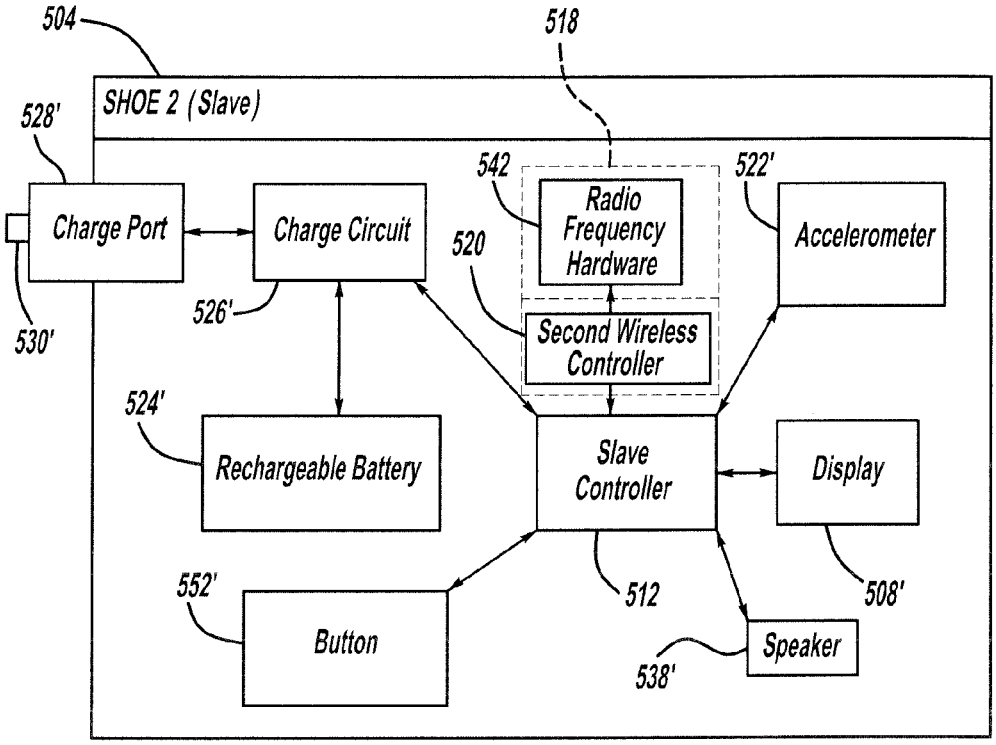
FIG. 16 is a schematic diagram of the second shoe.

FIG. 16 shows the details of the components of the second shoe 504. The second shoe 504 has a slave controller 512 that controls two or more modes of operation for displaying personalized content on said display panel of the second shoe. The personalized content and said modes of operation can be changed or erased on the slave controller 512 in response to signals received from the primary controller 510.

In order to facilitate the wireless communication between the wireless interface device 506, first shoe 502 and second shoe 504 a wireless radio frequency communication protocol is used. Such communication protocols include Bluetooth®, Zigbee, cellular or mobile phone systems and global positioning, satellite based systems. In order to allow wireless communication the first shoe 502 has a first shoe wireless communication bus 514 that includes a first wireless controller 516. The second shoe 504 has a second shoe wireless communication bus 518 that includes a second wireless controller 520 contained in the second shoe 504. The first shoe wireless communication bus 518 is capable of wireless communication between the first shoe wireless communication bus 518 and the second shoe wireless communication bus 520 or sending said output signals 503' or receiving said input signals 503 between the first shoe wireless communication bus 514 and the wireless interface device 506. The first wireless controller takes signals received through the first shoe wireless communication bus 514 and communicates with the primary controller 510. The second wireless controller 520 takes signals received by the second shoe wireless communication bus 518 and communicates with said slave controller 512. The second wireless controller 520 also send signals to the first shoe wireless controller 516 through the second shoe wireless communication bus 518 to the first shoe wireless communication bus 514. The signals sent from the first shoe wireless communication bus 514 to the second shoe wireless communication bus 518 are hereafter referred to as slave input signals 519 while signals sent in the opposite direction, that being from the second shoe wireless communication but 518 to the first shoe wireless communication bus 514 are referred to as slave output signals 519'. The slave input signal 519 and slave output signal 519' are single or a plurality of signals that can take many different forms and be used to achieve different results as will be described throughout this specification.

The first shoe 502 and the second shoe 504 each have an accelerometer 522,522'. While each shoe has an accelerometer it is within the scope of this invention for just one of the shoes to have an accelerometer. The accelerometer 522, 522' is a three axis MEMS accelerometer capable of detecting movement of the respective first shoe 502 or second shoe 504 within at least two axes. The accelerometer 522 is connected to and capable of generating one or more motion signals to said primary controller 510, while the accelerometer 522' is capable of generating one more motion signals to the slave controller 512, which are then conveyed to the primary controller 510 as a type of slave output signal 519'.

One feature of the present invention includes a hibernation mode that functions to save power usage of the footwear arrangement 500 by placing the primary controller 510 and slave controller 512 into a hibernating state. This can be accomplished by sending a specific type of input signal 503 from the wireless interface device 506 to the primary controller 512. The primary controller 512 will send a type of slave input signal 519 to the slave controller 512 that is a hibernation signal and the slave controller 512 will send a specific type of slave output signal 519' that is a hibernation acknowledgement signal to the primary controller 510. Both the primary controller 510 and slave controller 512 will hibernate.

During the hibernation mode the first wireless controller 514 and second wireless controller 520 both remain in an active mode when the primary controller 510 and slave controller 512 are both in said hibernation mode. In order to activate the primary controller 510 and slave controller 512 a different type of input signal 503, which is an activation signal is generated from the wireless interface device 506. The activation signal is received by the first wireless controller 516 and is transmitted to the primary controller 510 causing the primary controller 512 to operate in an activation mode and send a slave input signal 519 that is an activation signal, to the slave controller 512. The slave controller 512 sends a slave output signal 519' that is an activation acknowledgement signal to the primary controller 510.

Hibernation mode can also be implemented when the first shoe 502 and second shoe 504 are not in motion for a period of time, for example if the shoes are removed and stored, the primary controller 510 will generate a type of slave output signal 519 that is a hibernation mode signal through the first shoe wireless communication bus 514 to the second shoe wireless communication bus 518.

Once the hibernation mode signal is received by the slave controller 512 a slave output signal 519' that is a hibernation mode acknowledgement signal is sent to the primary controller 510 and the slave controller 512, and primary controller 510 will both power down and operate in a hibernation mode. In this particular aspect hibernation mode occurs when one or more motion signals from the accelerometer 522 is not received by the primary controller 510 for a preset time period programmed on the primary controller 502. When a motion signal is generated by the accelerometer 522 the primary controller 502 begin operating in activation mode and will generate a slave input signal 519 that is a slave controller activation signal to the slave controller 512 and the primary controller 502 and slave controller 512 will begin operating normally. The slave controller 512 will respond by generating a slave output signal 519' that is an activation acknowledgement signal to the primary controller 510.

When a motion signal is generated by the accelerometer 522' the slave controller 512 will activate and generate a slave output signal 519' that is a primary controller activation signal causing the primary controller 510 to activate. The primary controller will send a slave input signal 519 that is an activation acknowledgement signal to the slave controller 512.

The first shoe 502 has a first shoe rechargeable battery 524 located in the first shoe 502 for providing power to the primary controller 510, display panel 508, first shoe wireless communication bus 514 and accelerometer 522. The second shoe 504 has a second shoe rechargeable battery 524' located in the second shoe 504 for providing power to the slave controller 512, display panel 508', second shoe wireless communication bus 518 and accelerometer 522' in the second shoe 504. The rechargeable battery 524, 524' is any suitable battery, including but not limited to nickel cadmium, lithium including a single cell lithium ion battery with a Buck Converter to charge the battery or other suitable rechargeable battery.

Figure 17:
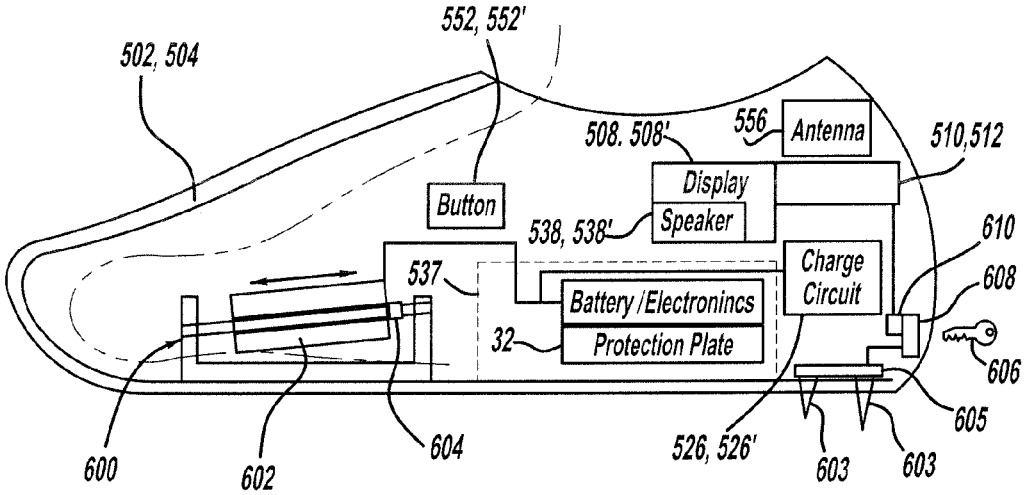
FIG. 17 is a schematic diagram of a shoe layout and the locations of the electronics.

Referring now briefly to FIG. 17, the first shoe 502 and second shoe 504 each have a kinetic recharging mechanism 600 contained within the shoe. The kinetic recharging mechanism 600 allows for a person wearing the shoe to recharge the battery and electronics portion through the charge circuit 526, 526' using the kinetic energy generated by the movement of the shoe 502, 504. In particular, the kinetic recharging mechanism 600 has a tube that can be copper, silver, gold, and be a solid tube or wrapped wire into a tube with a magnet 604 that is configured to slide through the tube 602, which in turn generates an electric current that is received by the charge circuit 526, 526' and recharges the battery portion of the invention. The shoe 502, 504 can include several kinetic recharging mechanisms 600 that are positioned at different angles within the shoe 502, 504 so that magnets 604 are sliding through tubes 602 when the shoe moves in any axial direction, thereby allowing kinetic energy to be collected by the movement of the shoe 502, 504 in any direction.

FIG. 17 also shows another anti-theft aspect of the shoe 502, 504 having a lock controller 610 with an aperture 608 for receiving a key 606. The key 606 is inserted into the aperture 608 and is turned to lock and unlock the shoe 502, 504. When the lock controller 606 is in the locked position a lock signal is sent to the controller 510, 512 that causes the controller 510, 512 to shut off and be inactive so several of the features of the shoe 502, 504, such as the display 508, 508 and speaker 538, 538' cannot be changed. The lock controller 606 does not disengage any of the anti-theft, and person locator features of the shoe, but instead makes stealing the shoe undesirable since several of the aspects of the shoe will be disengaged. In addition to inactivating portions of the controller 510, 512, the lock controller 606 also sends a signal, which can be an electronic signal or a mechanical connection between the lock controller 610 and a spike actuator 605. The spike actuator 605 causes spikes 603 of varying length to extend from the bottom of the shoe to cause the shoe 502, 504 to have an uneven bottom that makes walking in the shoe 502, 504 difficult and deters theft of the shoe 502, 504.

In yet another alternate embodiment of the anti-theft aspect of the shoe 502, 504 the lock controller 610 is a keypad with letters and or numbers for entering a password or passcode that will activate the lock signal and unlock signals, in the same manner as described above. This embodiment would eliminate the need to have a key 606 and aperture 608.

Figure 19:
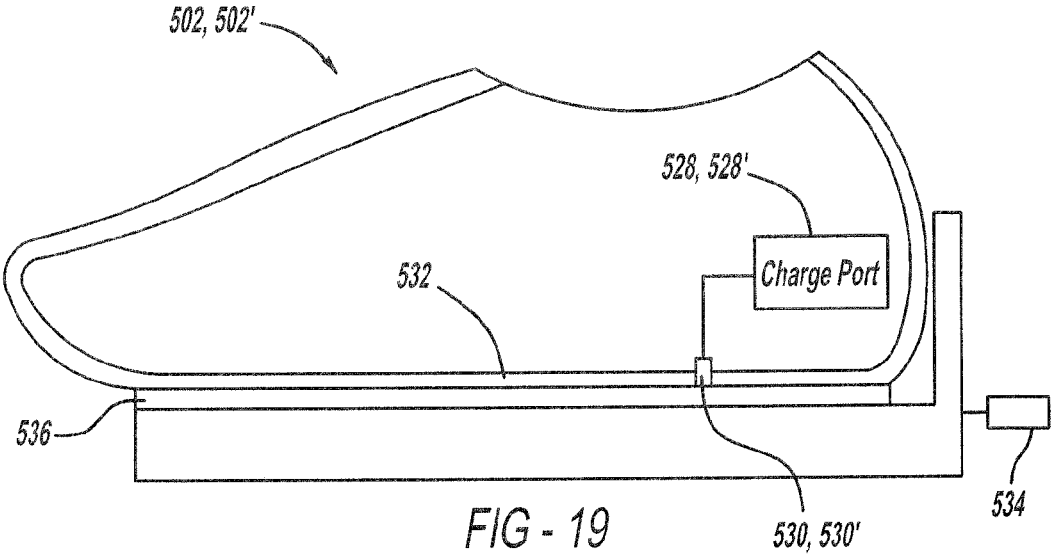
FIG. 19 is a schematic diagram of a shoe charging arrangement.

The rechargeable battery 524, 524' are recharged using direct charger ports 30 and connections 212 in the shoes as shown and described above with regard to FIGS. 5 and 8. Additionally FIG. 19 depicts an alternate charging circuit for the footwear arrangement 500. FIGS. 15, 16, 17 and 19 show a charge circuit 526, 526' in the first shoe 502 and second shoe 504 that connect the respective rechargeable battery 524, 524'. The respective charge circuits 526, 526' in the first shoe 502 and second shoe 504 each have an electrical lead 530, 530' for connecting to a charger. In FIG. 19 the electrical lead 530, 530' extends from an outside surface or a sole 532 of the first shoe 502 or second shoe 504 and electrically connects the charge port 528, 528' to an external power source 534 to a charge pad 536 when the 502 first shoe or the second shoe 504 are placed on the charge pad 536.

In another aspect of the present invention the footwear arrangement 500 is configured such that the components are packed into the sole of the shoe with potting material in order to waterproof or water resistant and capable of resisting water for up to thirty minutes. The potting material also protects the footwear arrangement 500 components from harm when the first shoe 502, or second shoe 504 are vertically dropped by a distance of at least four feet. In another aspect of the invention, the footwear can resist extreme heat and cold such as temperatures of less than 0° Celsius and greater than 40° Celsius. One way of accomplishing the cold resistance is the installation of heat sinks 537 which is a heat conductive metal plate located near the foot of a user and extending to a region near the rechargeable battery 524, 524' and primary controller 510 and slave controller 514 and other components in order to transfer heat from the foot of a user through the metal plate to the warm the components of the footwear arrangement 500.

As an alternate embodiment, all the components of the shoe 502, 504 are sealed within the sole and upper portion of the shoe so that there are no openings exposing the components to water. One possible way of accomplishing this is to encase the components of the shoe in polymer material, such as silicon or magnesium and then connect the encased components to the sold and upper of the shoe. In such embodiments the rechargeable battery can be recharged using kinetic motion of the shoes as described with reference to FIG. 17. A second alternate embodiment would have electrical leads 530 extend through the waterproof casing material to allow for recharging the shoe 502, 504 using a charge pad as described with reference to FIG. 19.

In another aspect of the invention the footwear arrangement 500 includes an audio speaker 538 in the first shoe 502 connected to the primary controller 510 and powered by the rechargeable battery 524. The wireless interface device 506 selectively sends input signal 503 which include an ON audio signal or an OFF audio signal to the primary controller 510. The ON audio signal activates the audio speaker 538 in the first shoe 502 to generate sound. The OFF audio signal causes the primary controller 510 to deactivate the audio speaker 538 in the first shoe 502 to stop generating sound.

An audio speaker 538' in the second shoe 504 is connected to the slave controller 512 and powered by the rechargeable battery 524'. The primary controller 510 sends a slave input signal 519 that is an ON audio signal to the slave controller 512 that activates the audio speaker 538' in said second shoe 504 to generate sound. The primary controller 510 sends a slave input signal 519 that is an OFF audio signal to the slave controller 512 which deactivates the audio speaker 538' in the second shoe 504 causing the audio speaker 538' to stop generating sound. Sound generated by the audio speaker 538, 538' include sounds programmed on the primary controller 510 or the slave controller 512 respectively. The types of sounds can include pre-recorded musical, environmental, whistling, languages, human voices such as professional athletes or entertainers, car or motorcycle engine sounds, animal sounds or voices that are uploaded from the wireless interface device 506 to the primary controller 510 or slave controller 512. One example of a typed of audio speaker is a piezoelectric speaker.

Figure 18:
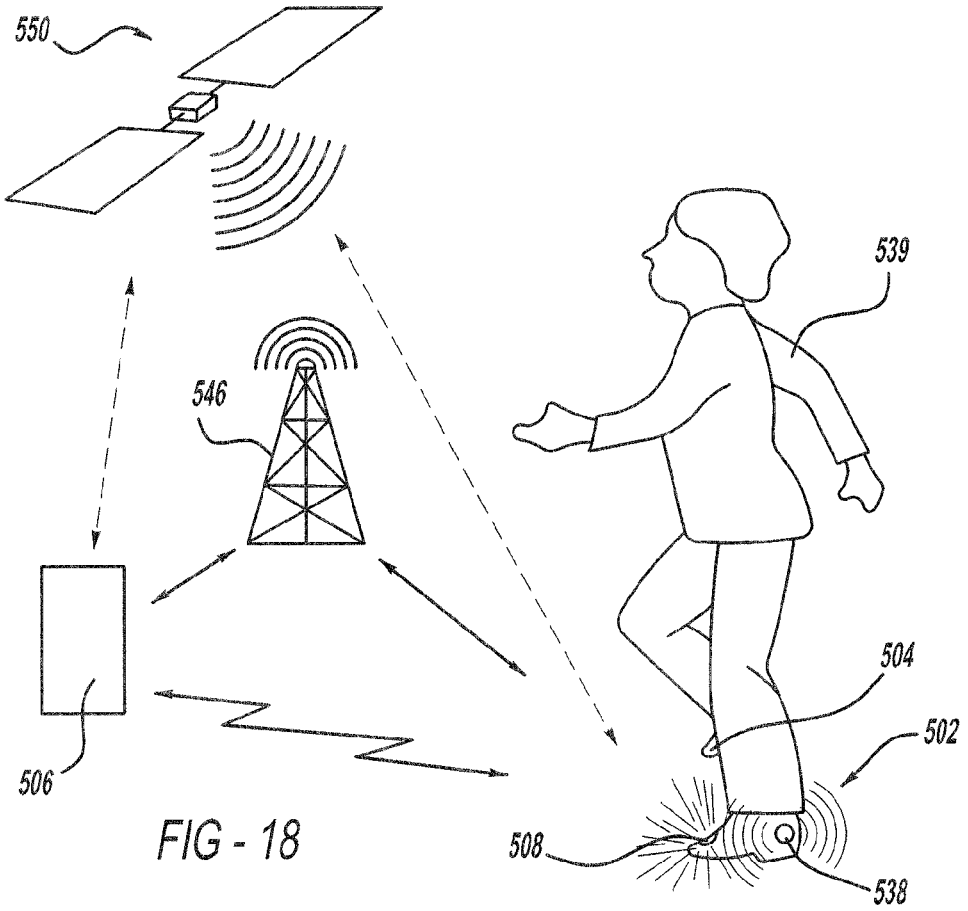
FIG. 18 is a schematic diagram of a remote tracking and activation of the audio speaker and display panel of the footwear arrangement.

The audio speaker 538, 538' and display panel 508, 508' both can be activated for the purpose of providing the user with entertainment or they can be used in connection with several functions of the footwear arrangement 500. These functions include a shoe locator feature, alarm or anti-theft feature and a missing person or amber alert feature, all of which may cause the audio speaker 538, 538' or display panel 508, 508' to be activated so that the shoes or the person wearing the shoes will be noticed by others. FIG. 18 demonstrates these features including several ways of communication between the wireless interface device 506 and shoe arrangement 500. As shown in FIG. 18 a person 539 wearing the shoe could be a lost child or a shoe thief. FIG. 18 also shoes how location feature works to locate the first shoe 502 or second shoe 504 if lost. In the shoe locator feature the display panel 508, 508' can be configured to flash light or in addition or separate from the display panel, a set of mounted lights on the article, such as the base or sole of the footwear will flash when desired in order to activate or find the shoe or article in the dark. It is also within the scope of this invention for the wireless interface device 506 to cause the display panel 508, 508' and hand held or mobile phone device to flash light faster when the user gets closer to the shoe or a directional indicator signal is achieved. Alternatively, wireless interface device 506 can cause the audio speakers 538, 538' to make a sound that speeds up or slows down when the wireless interface device 506 comes closer to the shoe 502, 504. It is also within the scope of the invention for the lights on the shoe and the speaker on the shoe to also flash or make faster sounds when the wireless interface device comes closer to the shoe in order to further assist the user.

Activation of the various features of the invention, including activating the audio speaker 538, 538' and display panel 508,508' involves sending input signals 503 and receiving output signals 503' between the first shoe wireless communication bus 514 and the wireless device 506. This is accomplished by using radio frequency hardware 540 that is part of the first shoe wireless communication bus 514 installed in the first shoe 502 and connected to the primary controller 510. The wireless interface device 506 also has radio frequency hardware 540 that will communicate with the first shoe wireless communication bus 514. Additionally the second shoe 504 has radio frequency hardware 542 that is part of the second shoe wireless communication bus 518 that is connected to the slave controller 512. This allows the electronics of the first shoe 502 and second shoe 504 to communicate using salve input signal 519 and slave output signal 519' which can be multiple signals of different types as described throughout this specification. An example of radio frequency hardware includes Bluetooth® hardware and other wireless protocols.

In addition to using radio frequency hardware to communicate between the wireless interface device 506 and the first shoe 502, it is desirable to provide other ways of communicating over greater distances. Therefore in an additional embodiment of the invention the first shoe wireless communication bus 514 includes a cellular communication circuit 544 that allows the wireless interface device 506 (which is a cellular enabled device) to send input signals 503 and receive output signals 503' from a cellular network 546. The cellular network 546 is used to provide location information of the first shoe 502 to the wireless interface device 506. The wireless interface device 506 contains software that allows a user to see the location of the first shoe 502. This is useful for locating lost or stolen shoes as well as lost persons. Additionally it is within the scope of this invention of the wireless interface device 506 to be programmed to share said information through an Amber Alert Network when used to locate lost persons.

A person using the wireless interface device 506 can also send an input signal 503 that is an alarm signal through the cellar network that will cause the audio speaker 538, 538' and display panel 508, 508' of the first shoe 502 and second shoe 504 to activate. This will result in the audio speaker 538, 538' make sounds and display panel 508, 508' to flash or light up. The audio speaker 538' and display panel 508' of the second shoe 504 will be activated by the slave input signals 519 from the primary controller 510. For the amber alert feature this will draw attention to the missing person who could be in danger. For the shoe location feature this will assist in locating the lost shoes. For the anti-theft feature this will draw unwanted attention to the thief. The types of sounds and lights displayed can vary depending on the feature activated. For example if the Amber Alert feature is activated the light flashed might be an amber color, while the sound made can be a loud voice calling for "Help" and saying that the person is missing or a voice indicating that the "Shoe has been stolen".

In addition to or in place of the cellular hardware 544 the first shoe wireless communication bus 514 of the footwear arrangement 500 also optionally includes global positioning system hardware 548 (GPS) in the first shoe 502 connected to the primary controller 510; this allows the wireless interface device 506 (which is a GPS enabled device) to send input signals 503, and receive output signals using a satellite 550. This allows for all of the features including the shoe locator, amber alert, anti-theft and alarm features of the footwear arrangement 500 to be activated using the satellite 550 and not necessarily rely on using a cellular network 546.

In both the first shoe 502 and the second shoe 504 communication is enhanced by the placing an antenna 556 in the heel of the shoe. The antenna 556 is part of the respective first shoe wireless communication bus 514 or the second shoe wireless communication bus 518. The use of the antenna 556 improves communication between shoes as well as the communicating range of the first shoe 502 with the wireless interface device 506.

In further regard to the anti-theft feature the footwear arrangement can additionally include motion sensors and pressure sensors that will trigger the audio speaker 538, 38' to emit a loud sound if the first shoe 502 or second shoe 504 is picked up and carried or placed on the foot by someone else. A private alphanumeric number on the wireless interface device 506 or an alphanumeric manual control on the first shoe 502 or second shoe 504 can be used to activate and de-activate the anti-theft feature. Another aspect of the invention includes a key that is inserted into the first shoe 502 or second shoe 504 or article in order to activate or de-activate the anti-theft feature.

In the current embodiment of the invention the accelerometer 522, 522' is used as a sensor to detect movement of the first shoe 502 or second shoe 504. The wireless interface device 506 selectively sends input signals 503 that include a shoe alarm ON signal or a shoe alarm OFF signal to the primary controller 510. The primary controller 510 operates in alarm mode and monitors the accelerometer 522 in the first shoe 502 to determine if the first shoe 502 is moving. The primary controller 510 activates the audio speaker 538 in the first shoe 502 to generate sound if the accelerometer 522 of the first shoe 502 sends a signal to the primary controller 510 indicating that the first shoe 502 is moving. If the shoe alarm OFF signal from said wireless interface device is sent this will cause the primary controller 510 to cease monitoring the accelerometer 522 of the first shoe 502 and deactivate the audio speaker 538 of the first shoe 502.

The primary controller 510 sends a shoe alarm ON signal or a shoe alarm OFF signal to the slave controller 512. The slave controller 512 operates in alarm mode and monitors the accelerometer 522' in the second shoe 504 to determine if the second shoe 504 is moving. The slave controller 512 activates the audio speaker 538' in the second shoe 504 to generate sound if the accelerometer 522' of the second shoe 504 sends a signal to the slave controller 512 indicating that the second shoe 504 is moving. If the primary controller 510 sends a shoe alarm OFF signal from the primary controller 510 this will cause the slave controller 512 to cease monitoring the accelerometer 522' of the second shoe 504 and deactivate the audio speaker 538' of the second shoe 504. In addition to generating sound the primary controller 510 can cause the display panel 508 of the first shoe 502 to flash if the first shoe 502 is moved when the primary controller 510 is operating in the alarm mode. The slave controller 512 will activate and cause the display panel 502' of the second shoe 504 to flash if the second shoe 504 is moved when the slave controller 512 is operating in said alarm mode.

The footwear arrangement 500 described can be implemented in more than just footwear, but can be used in connection with multiple articles of clothing including hats, handbags, backpacks, mobile phone carriers, and coats as shown and described above. If just a single article of clothing is used then only a primary controller 510 with associated components will be used. The new arrangement for being connected to apparel articles that include a display panel for communicating or displaying messages and other content as selected by a user.

In another aspect of the present invention includes the display panel 508, 508' is able to change the background color between red, orange, yellow, green, blue, etc.

In further regard to the Amber Alert feature the wireless interface device 506 can program the components of the first shoe 502 and second shoe 504 to continuously transmit location information to the wireless interface device 506. The wireless interface device 506 can be set to sound the alarm feature, amber alert feature or simply display a notice on the wireless interface device 506 indicating that the first shoe 502 or second shoe 504 has moved beyond a preset distance from the wireless interface device 506. The wireless interface device 506 in the present invention can be a mobile application either mounted on a controller or on a phone that can will alert a user of the remote that the proximity sensor or person wearing the article having the proximity sensors outside a set area. If, for example, the person wearing the footwear is found to be missing, the person having the remote control can activate an Amber Alert causing the display device on the article or footwear to emit an emergency signal such as flashing or playing sounds indicating that there is a lost person. Additionally, the Amber Alert technology can be web based so that alerts can be sent to other persons nearby and can even include a photograph of the individual wearing the article such as footwear or a phone number to contact the mobile device. In one aspect of the invention, the Amber Alert technology will allow parents or guardians of children to instantly send out messages to persons nearby if their child is missing and possibly in danger. Additionally, the Amber Alert technology has a GPS or locator tracking sensor that allows the person having the remote to locate the child. All the above described features of the present invention can be used in connection with footwear, all articles of clothing, backpacks, purses, bookbinders, wristbands, or other accessories.

Regarding activation and synchronization of the components of the footwear arrangement 500, setup of the communication will be initiated using software programmed on the wireless interface device 506. The user will initiate a pairing mode by holding a button 552 on the first shoe 502 and select a pair button or feature on the wireless interface device 506. After pairing of the first shoe 502, the user will be instructed by the wireless interface device 506 to hold down a button 554 on the second shoe 504. The wireless interface device 506 will then setup wireless communication with the second shoe 504 and then setup direct communication between first shoe 502 and the second shoe 504.

The description of the invention is merely exemplary in nature and; thus, variations that do not depart from the gist of the invention are intended to be within the scope of the invention. Such variations are not to be regarded as a departure from the spirit and scope of the invention.

What is claimed is:

1. A footwear arrangement comprising:

a wireless interface device capable of sending input signals and receiving output signals;

a first shoe having a display panel flexibly connected to said first shoe;

a second shoe having display panel flexibly connected to said second shoe;

a primary controller connected to said first shoe, wherein said primary controller controls two or more modes of operation for displaying personalized content on said display panel of the first shoe, wherein said personalized content and said modes of operation is changed or erased by said primary controller;

a slave controller connected to said second shoe, wherein said slave controller controls two or more modes of operation for displaying personalized content on said display panel of the second shoe, wherein said personalized content and said modes of operation is changed or erased on said slave controller;

a first shoe wireless communication bus with a first wireless controller contained within said first shoe and a second shoe wireless communication bus with a second wireless controller contained in said second shoe, wherein said first shoe wireless communication bus is capable of wireless communication between said first shoe wireless communication bus and said second shoe wireless communication bus or sending said output signals or receiving said input signals between said first shoe wireless communication bus and said wireless interface device; wherein said first wireless controller communicates with said primary controller and the second wireless controller and said second wireless controller communicates with said slave controller and the first wireless controller;

an accelerometer in said first shoe capable of detecting movement within at least two axes, said accelerometer being connected to and capable of generating one or more motion signals to said primary controller, wherein said primary controller will generate a hibernation mode signal so said slave controller and said primary controller and said slave controller will both operate in a hibernation mode when one or more motion signals are not received by the primary controller for a preset time period programmed on said primary controller;

a first shoe rechargeable battery located in said first shoe for providing power to said primary controller, said display panel in said first shoe, said first shoe wireless communication bus and said accelerometer in said first shoe;

a second shoe rechargeable battery located in said second shoe for providing power to said slave controller, said display panel in said second shoe, said second shoe wireless communication bus and said accelerometer in said second shoe;

a heat sink in each one of the first shoe and the second shoe where each heat sink is located near a respective foot of a user of said footwear arrangement and the heat sink in the first shoe extends near the first shoe rechargeable battery and the primary controller in the first shoe and the heat sink in the second shoe extends near the second shoe rechargeable battery and the slave controller of the second shoe, wherein each respective heat sink transfers heat from the respective foot of the user to the first shoe rechargeable battery in the first shoe and the respective foot of the user to the second shoe rechargeable battery in the second shoe.

2. The footwear arrangement of claim 1 wherein said first wireless controller and said second wireless controller both remain in an active mode when said primary controller and said slave controller are both in said hibernation mode, wherein one of said input signals from said wireless device is an activation signal that is received by said first wireless controller from said wireless interface device and is transmitted to said primary controller causing said primary controller to operate in an activation mode and send an activation signal to said slave controller using said first wireless communication bus to send said activation signal to said second wireless communication bus.

3. The footwear arrangement of claim 1 wherein said input signals generated from said wireless interface device include operational signals that direct said primary controller to operate said display panel on said first shoe in one of said two or more modes of operation and change or erase said personalized content.

4. The footwear arrangement of claim 3 wherein said input signals from said wireless interface device direct said primary controller to send slave operational signals to the slave controller using said first wireless communication bus to transmit said slave operational signals to said second wireless communication bus, wherein said slave operational signals direct said slave controller to operate said display panel on said second shoe in one of said two or more modes of operation and change or erase said personalized content.

5. The footwear arrangement of claim 1 wherein said wireless interface device is a smart phone with a software application capable of generating said activation signals and said input signals and receiving and interpreting said output signals.

6. The footwear arrangement of claim 1 further comprising:

a charge circuit in said first shoe connected to said rechargeable battery, wherein said charge circuit in said first shoe has a charge port with an electrical lead extending from an outside surface of said first shoe to said rechargeable battery of said first shoe allowing an external power source to be connected to said charge circuit for charging said rechargeable battery;

a charge circuit in said second shoe connected to said rechargeable battery, wherein said charge circuit in said second shoe has a charge port with an electrical lead extending from an outside surface of said second shoe to said rechargeable battery of said second shoe allowing an external power source to be connected to said charge circuit for charging said rechargeable battery; and a charge pad connected to said external power source, wherein said electrical lead of said first shoe and said electrical lead of said second shoe connect with said external power source through said charge pad when said first shoe and said second shoe are placed on said charge pad.

7. The footwear arrangement of claim 1 further comprising:

an audio speaker in said first shoe connected to said primary controller and powered by said rechargeable battery, wherein said wireless interface device selectively sends said input signals which include an ON audio signal or an OFF audio signal to said primary controller which activates said audio speaker in said first shoe to generate sound or said wireless interface selectively sends said OFF audio signal to said primary controller which deactivates said audio speaker in said first shoe to stop generating sound, and an audio speaker in said second shoe connected to said slave controller and powered by said rechargeable battery, wherein said primary controller sends an ON audio signal to said slave controller which activates said audio speaker in said second shoe to generate sound or an OFF audio signal to said slave controller, which deactivates said audio speaker in said second shoe causing said audio speaker to stop generating sound.

8. The footwear arrangement of claim 7 wherein said sound generated by said audio speaker of said first shoe or said sound generated by said second shoe include sounds programmed on said primary controller and said slave controller.

9. The footwear arrangement of claim 7 wherein said wireless interface device selectively sends input signals that are a shoe alarm ON signal or a shoe alarm OFF signal to said primary controller, wherein said primary controller operates in alarm mode and monitors said accelerometer in said first shoe to determine if said first shoe is moving, wherein said primary controller activates said audio speaker in said first shoe to generate sound if said accelerometer of said first shoe sends a signal to said primary controller indicating that said first shoe is moving and said shoe alarm OFF signal from said wireless interface device causes said primary controller to cease monitoring said accelerometer of said first shoe and deactivate said audio speaker of said first shoe; and said primary controller sends a shoe alarm ON signal or a shoe alarm OFF signal to said slave controller, wherein said slave controller operates in alarm mode and monitors said accelerometer in said second shoe to determine if said second shoe is moving, wherein said slave controller activates said audio speaker in said second shoe to generate sound if said accelerometer of said second shoe sends a signal to said slave controller indicating that said second shoe is moving and said shoe alarm OFF signal from said primary controller causes said slave controller to cease monitoring said accelerometer of said second shoe and deactivate said audio speaker of said second shoe.

10. The footwear arrangement of claim 9 wherein said primary controller causes said display panel of said first shoe to flash if said first shoe is moved when said primary controller is operating in said alarm mode and said slave controller will activate and cause said display panel of said second shoe to flash if said second shoe is moved when said slave controller is operating in said alarm mode.

11. The footwear arrangement of claim 1 wherein further comprising a cellular communication circuit in said first shoe and connected to said primary controller through said first shoe wireless communication bus, wherein said cellular communication circuit allows said wireless interface device to send input signals and receive output signals from a cellular network, wherein said cellular network is used to provide location information of the first shoe to the wireless interface device.

12. The footwear arrangement of claim 11 wherein said wireless device contains software that allows a user to see the location of said first shoe and share said information through an Amber Alert Network.

13. The footwear arrangement of claim 1 wherein further comprising global positioning system hardware in said first shoe and connected to said primary controller through said first shoe wireless communication bus allowing said wireless interface device to send input signals and receive output signals from said global positioning system hardware, wherein said global positioning system hardware is used to provide location information of the first shoe to the wireless interface device.

14. The footwear arrangement of claim 13 wherein said wireless device contains software that allows a user to see the location of said first shoe and share said information through an Amber Alert Network.

15. A footwear arrangement comprising:

a wireless interface device capable of sending input signals and receiving output signals;

a first shoe having a display panel flexibly connected to said first shoe;

a second shoe having display panel flexibly connected to said second shoe;

a primary controller connected to said first shoe, wherein said primary controller controls two or more modes of operation for displaying personalized content on said display panel of the first shoe, wherein said personalized content and said modes of operation is changed or erased by said primary controller;

a slave controller connected to said second shoe, wherein said slave controller controls two or more modes of operation for displaying personalized content on said display panel of the second shoe, wherein said personalized content and said modes of operation is changed or erased on said slave controller;

a first shoe wireless communication bus with a first wireless controller contained within said first shoe and a second shoe wireless communication bus with a second wireless controller contained in said second shoe, wherein said first shoe wireless communication bus is capable of wireless communication between said first shoe wireless communication bus and said second shoe wireless communication bus or sending said output signals or receiving said input signals between said first shoe wireless communication bus and said wireless interface device; wherein said first wireless controller receives and transmits signals to said primary controller and said second wireless controller receives and transmits signals to said slave controller;

an accelerometer in said first shoe capable of detecting movement within at least two axes, said accelerometer being connected to and capable of generating one or more motion signals to said primary controller, wherein said primary controller will generate a hibernation mode signal so said slave controller and said primary controller and said slave controller will both operate in a hibernation mode when one or more motion signals are not received from said accelerometer for a preset time period programmed on said primary controller;

a first shoe rechargeable battery located in said first shoe for providing power to said primary controller, said display panel in said first shoe, said first shoe wireless communication bus and said accelerometer in said first shoe;

a second shoe rechargeable battery located in said second shoe for providing power to said slave controller, said display panel in said second shoe, said second shoe wireless communication bus and said accelerometer in said second shoe;

an audio speaker in said first shoe connected to said primary controller and powered by said rechargeable battery, wherein said wireless interface device selectively sends said input signal that include a lost person ON signal or a lost person OFF signal to said primary controller, where said lost person ON signal activates said audio speaker in said first shoe to generate sound and said primary controller causes said display panel in said second shoe to flash or said wireless interface selectively sends the lost person OFF signal to said primary controller which deactivates said audio speaker in said first shoe to stop generating sound and said primary controller causes said display panel in said first shoe to stop flashing, an audio speaker in said second shoe connected to said slave controller and powered by said rechargeable battery, wherein said primary controller sends a lost person ON signal to said slave controller which activates said audio speaker in said second shoe to generate sound and said slave controller causes said display panel of said second shoe to flash or lost person OFF signal to said slave controller, which deactivates said audio speaker in said second shoe causing said audio speaker to stop generating sound and said slave controller causes said display panel in said second shoe to stop flashing, wherein said sound generated by said audio speaker of said first shoe or said sound generated by said second shoe include sounds programmed on said primary controller and said slave controller;

a heat sink in each one of the first shoe and the second shoe where each heat sink is located near a respective foot of a user of said footwear arrangement and the heat sink in the first shoe extends near the first shoe rechargeable battery and the primary controller in the first shoe and the heat sink in the second shoe extends near the second shoe rechargeable battery and the slave controller of the second shoe, wherein each respective heat sink transfers heat from the respective foot of the user to the first shoe rechargeable battery in the first shoe and the respective foot of the user to the second shoe rechargeable battery in the second shoe.

16. The footwear arrangement of claim 15 wherein further comprising a cellular communication circuit in said first shoe and connected to said primary controller through said first shoe wireless communication bus, wherein said cellular communication circuit allows said wireless interface device to send input signals and receive output signals from a cellular network, wherein said cellular network is used to provide location information of the first shoe to the wireless interface device.

17. The footwear arrangement of claim 16 wherein said wireless device contains software that allows a user to see the location of said first shoe and share said information through an Amber Alert Network.

18. The footwear arrangement of claim 15 wherein further comprising global positioning system hardware in said first shoe and connected to said primary controller through said first shoe wireless communication bus allowing said wireless interface device to send input signals and receive output signals from said global positioning system hardware, wherein said global positioning system hardware is used to provide location information of the first shoe to the wireless interface device.

19. The footwear arrangement of claim 18 wherein said wireless device contains software that allows a user to see the location of said first shoe and share said information through an Amber Alert Network.

20. The footwear arrangement of claim 15 wherein said first wireless controller and said second wireless controller both remain in an active mode when said primary controller and said slave controller are both in said hibernation mode, wherein one of said input signals from said wireless device is an activation signal that is received by said first wireless controller from said wireless interface device and is transmitted to said primary controller causing said primary controller to operate in an activation mode and send an activation signal to said slave controller using said first wireless communication bus to send said activation signal to said second wireless communication bus.

21. The footwear arrangement of claim 15 wherein said input signals generated from said wireless interface device include operational signals that direct said primary controller to operate said display panel on said first shoe in one of said two or more modes of operation and change or erase said personalized content.

22. The footwear arrangement of claim 21 wherein said input signals from said wireless interface device direct said primary controller to send slave operational signals to the slave controller using said first wireless communication bus to transmit said slave operational signals to said second wireless communication bus, wherein said slave operational signals direct said slave controller to operate said display panel on said second shoe in one of said two or more modes of operation and change or erase said personalized content.

23. The footwear arrangement of claim 15 wherein said wireless interface device is a smart phone with a software application capable of generating said activation signals and said input signals and receiving and interpreting said output signals.

24. The footwear arrangement of claim 15 further comprising:

a charge circuit in said first shoe connected to said rechargeable battery, wherein said charge circuit in said first shoe has a charge port with an electrical lead extending from an outside surface of said first shoe to said rechargeable battery of said first shoe allowing an external power source to be connected to said charge circuit for charging said rechargeable battery;

a charge circuit in said second shoe connected to said rechargeable battery, wherein said charge circuit in said second shoe has a charge port with an electrical lead extending from an outside surface of said second shoe to said rechargeable battery of said second shoe allowing an external power source to be connected to said charge circuit for charging said rechargeable battery; and a charge pad connected to said external power source, wherein said electrical lead of said first shoe and said electrical lead of said second shoe connect with said external power source through said charge pad when said first shoe and said second shoe are placed on said charge pad.

25. The footwear arrangement of claim 15 further comprising a lock controller and said lock controller in a locked position signaling said controller to activate and deactivate said display, wherein said lock controller having one of a group of devices including a device of a key for reception in an aperture of said lock controller to place said lock controller in a locked and unlocked position and a device of a keypad to punch in an alphanumeric password code to activate and deactivate said display by placing said lock controller in a locked or unlocked position.

26. The footwear arrangement of claim 15 further comprising a key lock controller and a wireless spike actuator with internal and external spike points that lengthen and extend upward inside the inner sole and downward outside the outer sole of footwear, thereby keeping said lock controller in a locked position while signaling said spike actuator to extend and pull back said spike points thereby discouraging theft of said footwear and preventing said footwear from being utilized if stolen.

27. The footwear arrangement of claim 15 further including a kinetic recharging mechanism contained in each one of the first shoe and the second shoe, wherein each kinetic recharging mechanism includes one or more tubes with wrapped magnet wire with a magnet configured to slide back and forth through each one of the one or more tubes to generate an electric current that recharges said rechargeable battery every time said footwear user moves said footwear.

28. The footwear arrangement of claim 1 further comprising a lock controller and said lock controller in a locked position signaling said controller to activate and deactivate said display, wherein said lock controller having one of a group of devices including a device of a key for reception in an aperture of said lock controller to place said lock controller in a locked and unlocked position and a device of a keypad to punch in an alphanumeric password code to activate and deactivate said display by placing said lock controller in a locked or unlocked position.

29. The footwear arrangement of claim 1 further comprising a key lock controller and a wireless spike actuator with internal and external spike points that lengthen and extend upward inside the inner sole and downward outside the outer sole of footwear, thereby keeping said lock controller in a locked position while signaling said spike actuator to extend and pull back said spike points thereby discouraging theft of said footwear and preventing said footwear from being utilized if stolen.

30. The footwear arrangement of claim 1 further including a kinetic recharging mechanism contained in each one of the first shoe and the second shoe, wherein each kinetic recharging mechanism includes one or more tubes with wrapped magnet wire with a magnet configured to slide back and forth through each one of the one or more tubes to generate an electric current that recharges said rechargeable battery every time said footwear user moves said footwear.

* * * * *